US008670683B2

(12) United States Patent
Takahashi et al.

(10) Patent No.: US 8,670,683 B2
(45) Date of Patent: Mar. 11, 2014

(54) IMAGE FORMING APPARATUS

(75) Inventors: Katsunori Takahashi, Hachioji (JP); Masashi Sugano, Hachioji (JP); Akinori Kimata, Toyokawa (JP); Akifumi Isobe, Hidaka (JP); Jun Onishi, Hino (JP); Masahito Takano, Hachioji (JP); Kenji Tamaki, Tokorozawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 146 days.

(21) Appl. No.: 13/191,206

(22) Filed: Jul. 26, 2011

(65) Prior Publication Data

US 2012/0027443 A1 Feb. 2, 2012

(30) Foreign Application Priority Data

Jul. 29, 2010 (JP) ..... 2010-170729

(51) Int. Cl.
*G03G 15/00* (2006.01)

(52) U.S. Cl.
USPC ..... 399/36; 399/46; 399/167

(58) Field of Classification Search
USPC ..... 399/36, 46, 167
See application file for complete search history.

(56) References Cited

U.S. PATENT DOCUMENTS

| | | | | |
|---|---|---|---|---|
| 7,162,192 | B2 * | 1/2007 | Yamada et al. | 399/302 |
| 7,444,092 | B2 * | 10/2008 | Naito et al. | 399/50 |
| 7,684,083 | B2 * | 3/2010 | Robles-Flores | 358/1.9 |
| 8,059,998 | B2 * | 11/2011 | Koike | 399/302 |
| 2004/0127317 | A1 * | 7/2004 | Takuroh et al. | 474/117 |
| 2010/0142979 | A1 * | 6/2010 | Atarashi | 399/36 |

FOREIGN PATENT DOCUMENTS

| | | | | |
|---|---|---|---|---|
| JP | 60-42771 | | 3/1985 | |
| JP | 2005-164678 | | 6/2005 | |
| JP | 2009259224 | A * | 11/2009 | |
| JP | 2009265444 | A * | 11/2009 | G03G 15/16 |
| JP | 2010-122591 | | 6/2010 | |

OTHER PUBLICATIONS

Machine translation of Japanese Patent 2005164678. Jun. 23, 2005.*
Notification of Reasons for Refusal with English Language translation mailed by the Japanese Patent Office on Sep. 10, 2013, in counterpart Japanese application No. 2010-170729.

* cited by examiner

*Primary Examiner* — David Gray
*Assistant Examiner* — Carla Therrien
(74) *Attorney, Agent, or Firm* — Finnegan, Henderson, Farabow, Garrett & Dunner, L.L.P.

(57) ABSTRACT

An image forming apparatus including: a photoreceptor for bearing a toner image; a transfer body onto which the toner image borne by the photoreceptor is transferred; a drive section for driving the photoreceptor and transfer body respectively, and a control section for controlling the drive section so as to drive the photoreceptor and transfer body at a predetermined driving speed, wherein the control section, under a state in which the control section controls to drive the transfer body at the predetermined driving speed, controls to: a) drive the photoreceptor while changing the driving speed of the photoreceptor within a range of driving speeds between low speed and high speed, including the predetermined driving speed, b) extract torque characteristics under the control which includes the change of driving speed of the photoreceptor, and c) determine the driving speed of the photoreceptor based on the extracted torque characteristics.

10 Claims, 5 Drawing Sheets

IMAGE FORMING APPARATUS

This application is based on Japanese Patent Application No. 2010-170,729 filed on Jul. 29, 2010 with the Japanese Patent Office, the entire content of which is hereby incorporated by reference.

TECHNICAL FIELD

The present invention relates to an image forming apparatus in which a toner image formed on a photoreceptor is transferred onto a transfer body, more particularly, relates to a control in which the photoreceptor and transfer body are rotated or moved in a condition that the surface speeds of the photoreceptor and the transfer body relatively coincide.

BACKGROUND OF THE INVENTION

In an image forming apparatus of an electro-photographic method, a toner image is formed on an image bearing member such as a rotating photoreceptor drum or a moving photoreceptor belt, and the formed toner image is transferred onto a transfer body such as a transfer drum or transfer belt, then, further transferred onto a recording medium from the transfer body, and formation of an image is thus performed.

Particularly, in an image forming apparatus which forms a full color image, a method is employed in which a toner image of each color is formed on each of a plurality of photoreceptors, and the toner image of each color, having been formed, is superposed on a transfer body, and formation of a full color image is thus performed.

In those cases, image transfer needs to be carried out while the photoreceptor and the transfer body rotate or move at the same surface speed. Differences between the surface speeds of the photoreceptor and the transfer body may cause a visible image drift or color drift.

Also, in cases in which the photoreceptor and the transfer body contact each other under the condition that the surface speeds of the photoreceptor and the transfer body are not the same, because the friction coefficient between the photoreceptor and the transfer body varies significantly depending on the existence or non-existence of toner between the photoreceptor and the transfer body, load fluctuation on both sides of the photoreceptor and the transfer body increases, resulting in a possible driving error.

Because of this, it is preferable to rotate or move the photoreceptor and the transfer body at the same surface speed. However, due to the influence of the dimensional variations occurring in the diameter of photoreceptor drum, the diameter of transfer body driving roller, the thickness of transfer belt, and the like, an image drift or color drift may occur even if the motor and drive shaft are controlled so as to rotate or move the photoreceptor and the transfer body at a same predetermined driving speed, because a relative difference in surface speed between the surfaces of the photoreceptor and the surface of the transfer body actually occurs.

In such a case, a technique is disclosed by Unexamined Japanese Patent Application Publication No. 1985-42771 (hereinafter referred to as Patent Document 1) as follow.

According to Patent Document 1, it is possible to maintain the moving speed at the surfaces of the photoreceptor or the transfer body to be constant, without the effect of errors in diameters of the photoreceptor and the transfer body driving roller, by: a) providing detected sections for speed detection placed on the surface of the photoreceptor or the surface of the transfer body at a predetermined interval, b) detecting the detected sections by a sensor, and c) carrying out feedback to control the rotation speed of a motor, which drives the photoreceptor or the transfer body, based on the results detected by the sensor.

However, in order to carry out such control, it is necessary to provide detected sections exclusively on a photoreceptor and a transfer body. Further, it is necessary to provide a sensor near the detected sections. As a result, the manufacturing cost of the apparatus is likely to increase.

SUMMARY OF THE INVENTION

The present invention has been achieved in consideration of the above problems, and to provide an image forming apparatus capable of driving a photoreceptor and a transfer body at the same surface speed without needing to detect the surface speed of the photoreceptor or the transfer body.

To achieve at least one of the above-stated objects, an image forming apparatus reflecting one aspect of the present invention may include, but is not limited to: a photoreceptor for bearing a toner image, a transfer body onto which the toner image borne by the photoreceptor is transferred, a drive section for driving the photoreceptor and the transfer body, respectively, and a control section for controlling to drive the photoreceptor and the transfer body at a predetermined driving speed, wherein the control section is configured, under a state in which the control section controls to drive the transfer body at the predetermined driving speed, to control to: a) drive the photoreceptor while changing the driving speed of the photoreceptor within a range of driving speeds between a low speed and a high speed, including the predetermined driving speed, b) extract torque characteristics in the control which includes the change of driving speed of the photoreceptor, and c) determine the driving speed of the photoreceptor based on the extracted torque characteristics.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

Now, a preferred embodiment of an image forming apparatus according to the present invention will be described in detail with reference to the accompanying drawings, without the present invention being limited to the embodiment.

[Composition of Image Forming Apparatus 100]

Here, the composition of image forming apparatus 100 of an electro photographic method according to a first preferred embodiment will be described in detail with reference to FIGS. 1 and 2. Note that explanations for general sections, which are well known as image forming apparatus 100 and are not directly related to distinguishing operations or controls of this preferred embodiment, are omitted.

Also note that, although a color image forming apparatus using four colors of toners, namely, yellow Y, magenta M, cyan C, and black K, is used as a concrete example in this preferred embodiment, a monochrome image forming apparatus, or a color image forming apparatus using different colors of toners, or a different number of color toners, may be used as an example.

Figure 1:
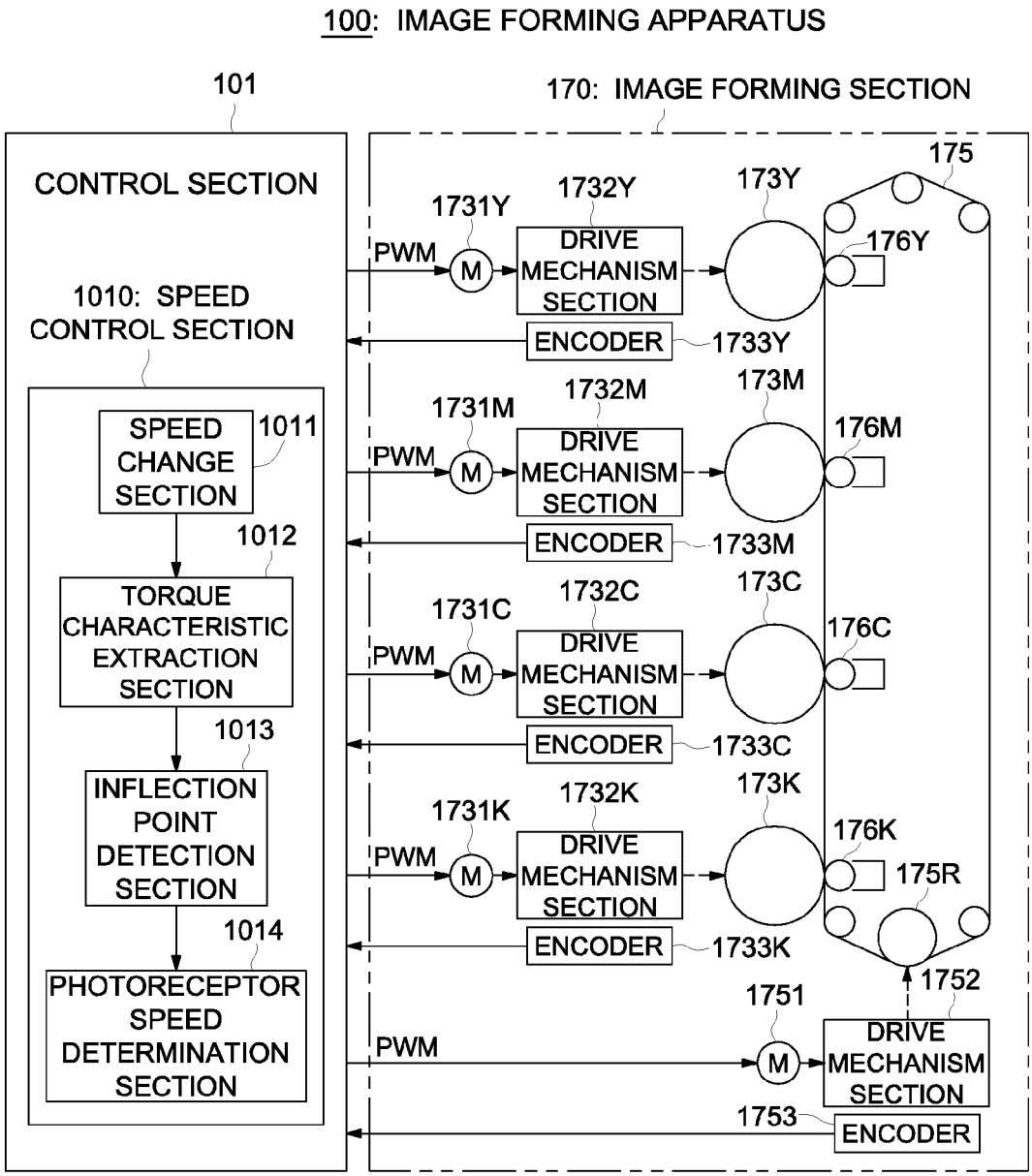
FIG. 1 is a configuration diagram showing a schematic composition of a preferred embodiment of the present invention.

Image forming apparatus 100, according to this embodiment, is composed of control section 101, which is composed of a CPU (Central Processing Unit), and the like, and controls the components constituting the apparatus, and image forming section 170 as shown in FIG. 1.

Image forming section 170 is composed of, but not limited to, a) motor 1731Y which rotates by receiving a PWM (Pulse Width Modulation) signal from control section 101, b) drive mechanism section 1732Y which drives photoreceptor 173Y by decelerating the rotation speed of motor 1731Y at a predetermined reduction ratio, c) encoder 1733Y which detects the driving speed of a drive shaft, or the like, of drive mechanism section 1732Y, and sends an instruction to control section 101, d) photoreceptor 173Y onto which a toner image of yellow Y is formed while being rotated by a rotational force derived from motor 1731Y, e) motor 1731M which rotates by receiving a PWM (Pulse Width Modulation) signal from control section 101, f) drive mechanism section 1732M which drives photoreceptor 173M by decelerating the rotation speed of motor 1731Y at a predetermined reduction ratio, g) encoder 1733M which detects the driving speed of a drive shaft, or the like, of chive mechanism section 1732M, and sends an instruction to control section 101, h) photoreceptor 173M onto which a toner image of magenta M is formed while being rotated by a rotational force derived from motor 1731M, i) motor 1731C which rotates by receiving a PWM (Pulse Width Modulation) signal from control section 101, j) drive mechanism section 1732C which drives photoreceptor 173C by decelerating the rotation speed of motor 1731C at a predetermined reduction ratio, k) encoder 1733C which detects the driving speed of a drive shaft, or the like, of drive mechanism section 1732C, and sends an instruction to control section 101, l) photoreceptor 173C onto which a toner image of cyan C is formed while being rotated by a rotational force derived from motor 1731C, m) motor 1731K which rotates by receiving a PWM (Pulse Width Modulation) signal from control section 101, n) drive mechanism section 1732K which drives photoreceptor 173K by decelerating the rotation speed of motor 1731K at a predetermined reduction ratio, o) encoder 1733K which detects the driving speed of a drive shaft, or the like, of drive mechanism section 1732K, and sends an instruction to control section 101, and p) photoreceptor 173K onto which a toner image of black K is formed while being rotated by a rotational force derived from motor 1731K. Image forming section 170 is further composed of, but not limited to, a) motor 1751 which rotates by receiving a PWM (Pulse Width Modulation) signal from control section 101, b) drive mechanism section 1752 which drives transfer body 175 by decelerating the rotation speed of motor 1751 at a predetermined reduction ratio, c) encoder 1753 which detects the driving speed of a drive shaft, or the like, of drive mechanism section 1752, and sends an instruction to control section 101, d) transfer body driving roller 175R which transmits a driving force of drive mechanism section 1752 to transfer body 175, e) transfer body 175 onto which each color toner image from photoreceptors 173Y-173K is transferred while being rotated by a rotational force derived from motor 1751, and f) primary transfer sections 176Y-176K to transfer each color image from photoreceptors 173Y-173K onto transfer body 175.

In the explanations of this preferred embodiment, motors 1731Y-1731K, which are drive members, are collectively called motor 1731 when it is not necessary to distinguish the motors. Similarly, drive mechanism sections 1732Y-1732K are collectively called drive mechanism section 1732 when it is not necessary to distinguish the drive mechanism sections. In a similar fashion, encoders 1733Y-1733K are collectively called encoder 1733 when it is not necessary to distinguish the encoders, photoreceptors 173Y-173K are collectively called photoreceptor 173 when it is not necessary to distinguish the photoreceptors, and primary transfer sections 176Y-176K are collectively called primary transfer section 176 when it is not necessary to distinguish the primary transfer sections.

Control section 101 controls image forming apparatus 100 in a centralized manner by controlling the components constituting image forming apparatus 100 and carrying out various types of arithmetic processing in accordance with the control programs of image forming apparatus 100, and based on OS (Operating System) or firmware and the like, having been installed.

Control section 101 is also composed of a) speed control section 1010 which includes speed change section 1011 which is configured, under a control state in which transfer body 175 is driven at a predetermined driving speed, to control to drive photoreceptors 173Y-173K while changing the driving speed of photoreceptors 173Y-173K within a range of driving speeds between a low speed and a high speed, including the predetermined driving speed, b) torque characteristics extraction section 1012 which extracts torque characteristics in the control which includes the change of driving speed of photoreceptors 173Y-173K, c) inflection point detection section 1013 which detects the inflection point of drive torque based on the extracted torque characteristics, and d) photoreceptor speed determination section 1014 which determines the driving speed, which corresponds to the extracted inflection point, as the driving speed of photoreceptors 173Y-173K.

Figure 2:
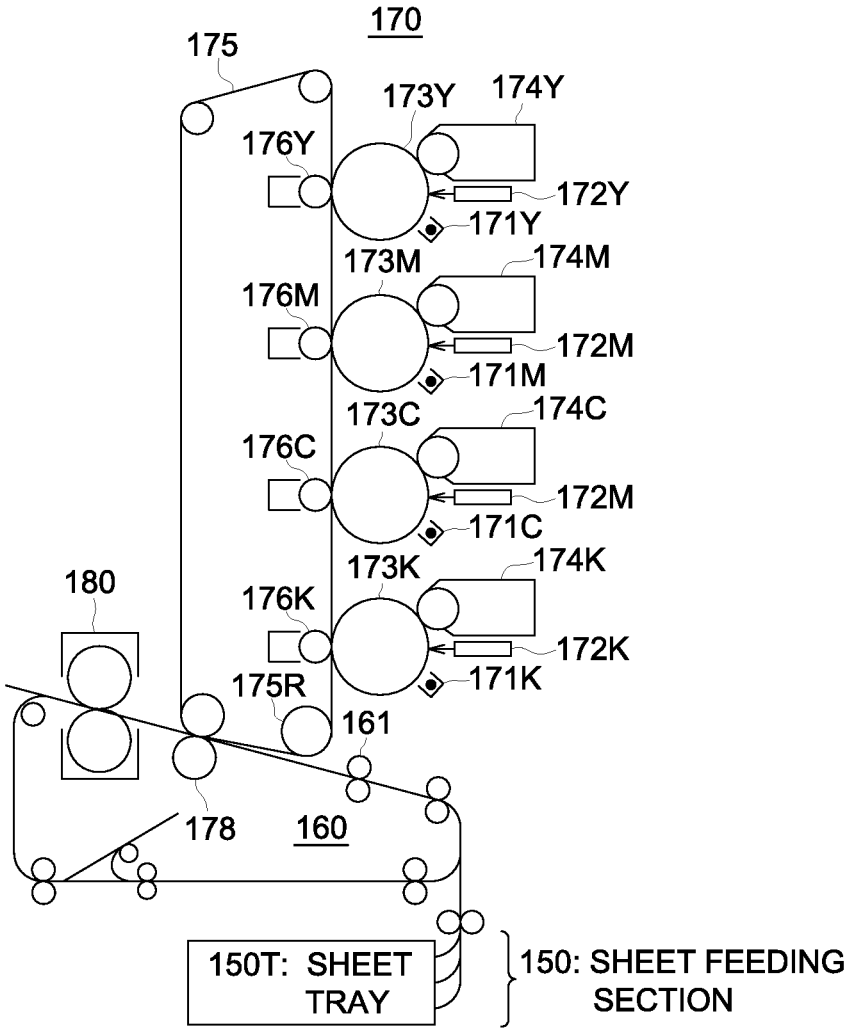
FIG. 2 is another configuration diagram showing a schematic composition of a preferred embodiment of the present invention.

In FIG. 2, sheet feeding section 150 is a feeding means to feed recording media stacked on a plurality of sheet trays 150T, one by one via feed rollers to an image forming position.

Conveyance section 160 is a conveyance means to convey the recording medium, fed from sheet feeding section 150 one by one, at a predetermined conveying speed, and is equipped with registration rollers 161 and other various types of conveying rollers. Here, registration rollers 161 correspond to a conveyance means to convey the recording medium, while sandwiching the recording medium, at the upstream side of a transfer means.

Image forming section 170 is a process unit which carries out various types of operations to form an image on a recoding medium, and is composed of but not limited to, a) photoreceptor 173 (173Y-173K) as an image bearing member which is exposed while rotating in a predetermined direction, b) charging section 171 (171Y-171K) which operates to give a predetermined electric potential to photoreceptor 173, c) exposure section 172 (172Y-172K) which exposes photoreceptor 173 in response to image data, d) developing section 174 (174Y-174K) which forms a toner image by developing the electrostatic latent image having been formed on photoreceptor 173 via exposure, e) transfer body 175 which is an endless belt bearing the toner images of each color, having been transferred from photoreceptor 173, f) primary transfer section 176 (176Y-176K) which transfers the toner image from photoreceptor 173 onto transfer body 175, and g) secondary transfer section 178 which transfers the toner image, having been transferred onto transfer body 175, onto a recording medium.

Fixing section 180 is to fix the toner image, having been transferred from transfer body 175 onto the recording medium, in a stable condition via heat and pressure.

[Operations in the Composition of the Preferred Embodiment]

Surface speed matching control for photoreceptor 173 and transfer body 175 of image forming apparatus 100, according to this preferred embodiment, will now be described with reference to the flow chart shown in FIG. 3 and characteristics diagrams shown in FIGS. 4 and 5.

In the explanations below, surface speed herein refers to either the speed of the surface of photoreceptor 173, or the speed of the surface of transfer body 175. Driving speed herein refers to the speed, detected via an encoder, or the like, at a driving shaft when photoreceptor 173 and transfer body 175 are driven. Instruction speed herein refers to the target speed as instruction to the speed detected via an encoder, or the like, at a driving shaft when photoreceptor 173 and transfer body 175 are driven. In other words, instruction speed Vi, for example, is the target speed so that the speed detected at a driving shaft via an encoder, namely, driving speed, becomes Vi.

In order to simplify the explanations, a case in which the surface speed of photoreceptor 173 and the surface speed of transfer body 175 are controlled to be relatively matched in the case of a monochrome image forming apparatus, or a case in which the surface speed of transfer body 175 and the surface speed of either one of photoreceptors 173Y-173K are controlled to be relatively matched in a color image forming apparatus, will be described.

Figure 3:
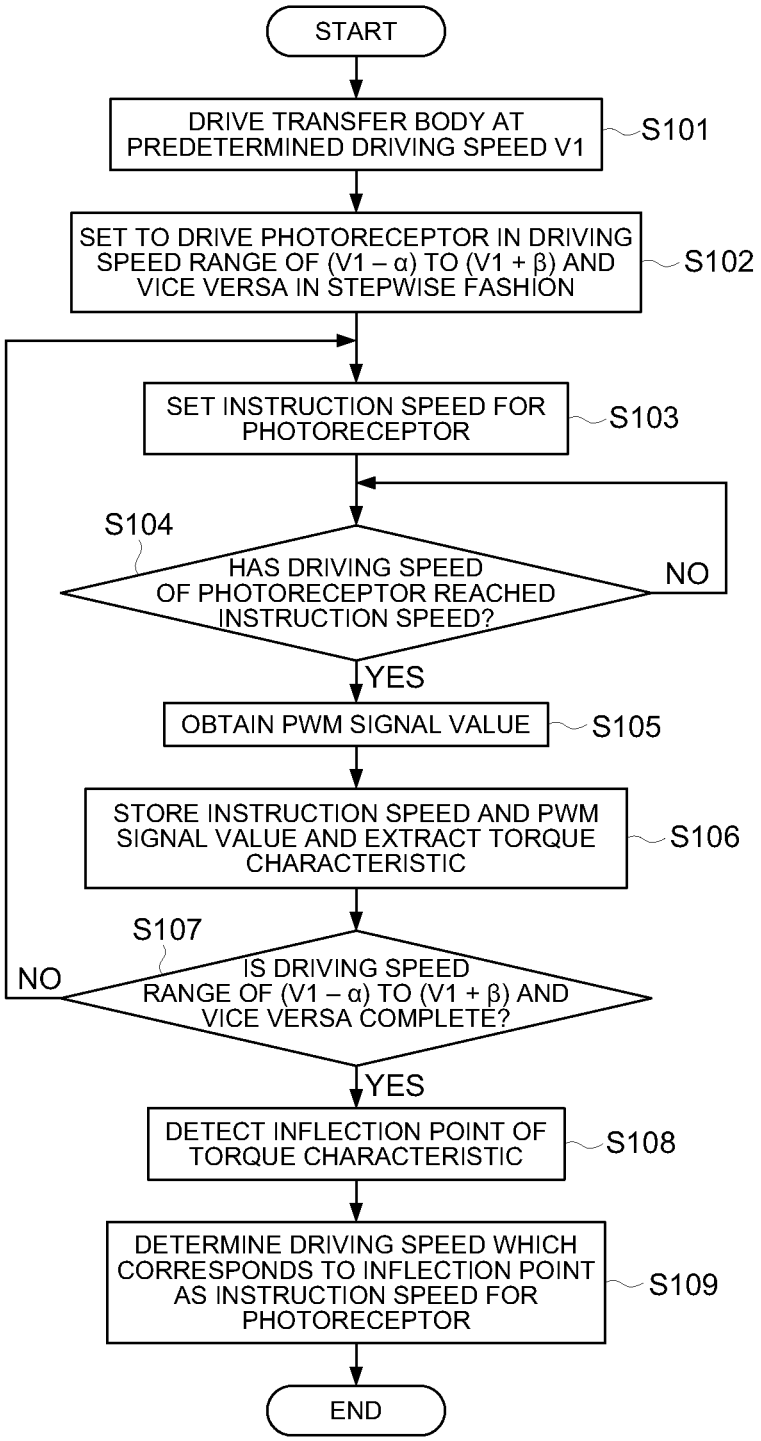
FIG. 3 is a flow chart showing an operation of a preferred embodiment of the present invention.

At first, control section 101 drives motor 1751 so that transfer body 175 is driven at a predetermined driving speed V1 (step S101 in FIG. 3). In this case, control section 101 gives a PWM signal, which corresponds to instruction speed V1, to motor 1751 by referring the detected result of encoder 1753 which is attached near the shaft of transfer body driving roller 1758, instead of detecting the actual surface speed of transfer body 175, so that transfer body 175 is driven at the predetermined driving speed V1.

Note that, as previously described, due to an error in the diameter of transfer body driving roller 175R and the thickness of transfer body 175, or the like, there is a possibility that actual surface speed V1' of transfer body 175 includes a slight error when compared to desired predetermined driving speed V1.

Then, control section 101 configures various types of settings for driving motor 1751 so that photoreceptor 173 is driven while changing the driving speed in a stepwise fashion such as 100 steps, 200 steps, or the like, within the range between driving speed (V1−α) to driving speed (V1+β) including the predetermined driving speed V1 (step S102 in FIG. 3). In other words, control section 101 determines the range of driving speed of photoreceptor 173, determines the number of steps, configures the setting of each instruction speed corresponding to the number of steps, prepares to store torque characteristics, which will be described later, and the like.

Here, it is necessary to set α and β so as to cover the relative difference between the surface speed of photoreceptor 173 and the surface speed of transfer body 175. Note that α and β may be the same value, or different values.

In other words, as previously explained, due to an error in the diameter of photoreceptor 173, there is a possibility that actual surface speed V1" of photoreceptor 173 includes a slight error when compared to desired predetermined driving speed V1 even if photoreceptor 173 is driven by the desired predetermined driving speed V1 which corresponds to the instruction speed. Therefore, by driving photoreceptor 173 within the range between driving speed (V1−α) and driving speed (V1+β), the actual surface speed V1' of transfer body 175 can be covered.

As an example, in a case in which there is a possibility that each of the actual surface speed V1" of photoreceptor 173 and the actual surface speed V1' of transfer body 175 includes an error in the range of ±0.1% from the predetermined instruction speed V1, there is a possibility that the error, between the actual surface speed V1" of photoreceptor 173 and the actual surface speed V1" of transfer body 175, becomes a relative error in the range of 0.2% at a maximum from the predetermined instruction speed V1. Therefore, by assigning the values in the range of 2 times the expected maximum error to α and β, respectively, the relative difference between the actual surface speed V1" of photoreceptor 173 and the actual surface speed V1' of transfer body 175 can be assuredly covered.

Speed change section 1011, in control section 101, generates, at first, a PWM signal to motor 1731 by setting driving speed (V1−α) as the instruction speed to photoreceptor 173 (step S103 in FIG. 3). Here, control section 101 refers to the detected result of encoder 1733, and adjusts the PWM signal so that photoreceptor 173 is driven by motor 1731 at the driving speed which corresponds to driving speed (V1−α) (step S104 in FIG. 3). When the driving speed of photoreceptor 173 is determined to have reached the instruction speed (step S104: YES in FIG. 3), torque characteristics extraction section 1012, in control section 101, obtains the PWM signal value at that time (step S105 in FIG. 3), and stores the PWM signal value together with the instruction speed (step S106 in FIG. 3).

Then, speed change section 1011 changes the instruction speed for photoreceptor 173 in a stepwise fashion toward driving speed (V1+β) from driving speed (V1−α), and repeats the generation of the PWM signals for motor 1731 by setting the instruction speed for photoreceptor 173 in accordance with the number of steps, having been set (step S107: NO and S103 in FIG. 3). Here, torque characteristics extraction section 1012, in control section 101, repeats the operations of storing the values of PWM signals, in the state in which photoreceptor 173 is driven by motor 1731 at the driving speed which corresponds to the instruction speed, together with the instruction speed (step S106 in FIG. 3).

For accuracy enhancement, after the above processing is complete, another processing, in which the order of the instruction speed for photoreceptor 173 is reversed, is carried out. More specifically, speed change section 1011, in control section 101, generates a PWM signal to motor 1731 by setting driving speed (V1+.beta.) as the instruction speed to photoreceptor 173 (step S103 in FIG. 3). Here, control section 101 refers to the detected result of encoder 1733, and adjusts the PWM signal so that photoreceptor 173 is driven by motor 1731 at the driving speed which corresponds to driving speed (V1+.beta.) (step S104 in FIG. 3).

When photoreceptor 173 is determined to have reached the instruction speed (step S104: YES in FIG. 3), torque characteristics extraction section 1012, in control section 101, obtains the PWM signal value at that time (step S105 in FIG. 3), and stores the PWM signal value together with the instruction speed (step S106 in FIG. 3). Then, speed change section 1011, in control section 101, changes the instruction speed for photoreceptor 173 in a stepwise fashion toward driving speed (V1−α) from driving speed (V1+β), and repeats the generation of the PWM signals for motor 1731 by setting the instruction speed for photoreceptor 173 in accordance with the number of steps, having been set (step S107: NO and step S103 in FIG. 3). Here, torque characteristics extraction section 1012, in control section 101, repeats the operations of storing the values of PWM signals, in the state in which photoreceptor 173 is driven by motor 1731 at the driving speed which corresponds to the instruction speed, together with the instruction speed (step S106 in FIG. 3).

Figure 4A:
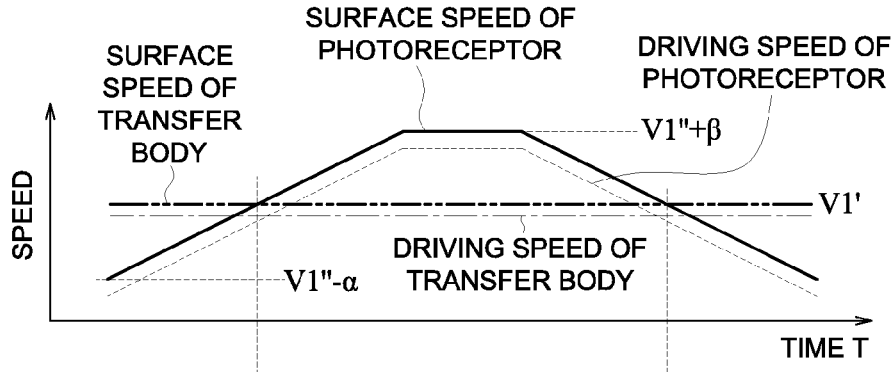
FIGS. 4*a* to 4*c* each is a characteristics diagram showing an operation of a preferred embodiment of the present invention.
Figure 4B:
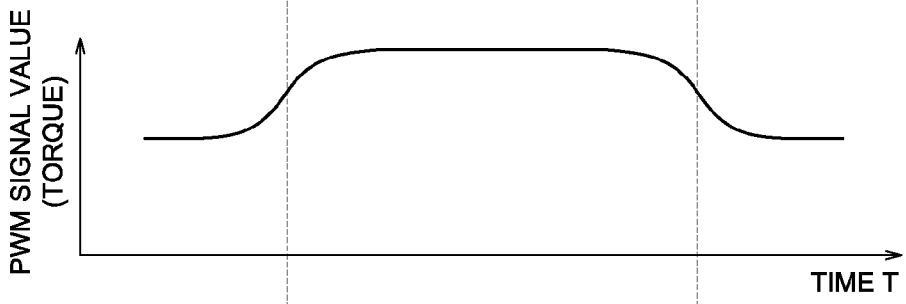

FIG. 4*a* shows the relationship between the surface and driving speeds of transfer body 175, and the surface and driving speeds of photoreceptor 173. Here, the driving speed which corresponds to the instruction speed for transfer body 175 is shown by an alternate long and short dash line in FIG. 4*a*, the surface speed of transfer body 175 is shown by an alternate long and two-short dashes line in FIG. 4*a*, the driving speed which corresponds to the instruction speed for photoreceptor 173 is shown by a short dashed line in FIG. 4*a*, and the surface speed of photoreceptor 173 is shown by a solid line in FIG. 4*a*.

In other words, photoreceptor 173 is started to be driven at driving speed (V1−α) which is slower than the predetermined driving speed V1 of transfer body 175, and the driving speed exceeds the predetermined driving speed V1 of transfer body 175, and then, photoreceptor 173 is started to be driven by driving speed (V1+β) which is faster than the predetermined driving speed V1 of transfer body 175, and back to the state of the slower driving speed. The instruction speed for photoreceptor 173 is set so as to establish such a state.

Also, because the PWM signal value is proportional to the torque of motor 1731, the PWM signal value and the instruction speed, which have been stored in step S106, represent torque characteristics of motor 1731 which is required for the driving speed of photoreceptor 173 under the condition that transfer body 175, which is driven at the predetermined driving speed, and photoreceptor 173, of which the driving speed varies, are in contact with each other.

Note that, under the state in which the surface speed of photoreceptor 173 is slower than the surface speed of transfer body 175, photoreceptor 173 is the one which is driven by transfer body 175, and it is in a state where the PWM signal value, namely the torque, is smaller. On the other hand, under the state in which the surface speed of photoreceptor 173 is faster than the surface speed of transfer body 175, photoreceptor 173 is the one which drives transfer body 175, and it is in a state where the PWM signal value, namely the torque, is larger.

After the above mentioned processing, in which the order of the instruction speed for photoreceptor 173 is reversed, is complete (step S107: YES in FIG. 3), inflection point detection section 1013, in control section 101, then, detects the inflection point of the torque characteristics (FIG. 4*b*) which has been extracted at step S106 (step S108 in FIG. 3). Here, the inflection point represents a point at which the sign of curvature, of a plane curve, changes. Namely, the point where the slope of the PWM signal value reaches its maximum is the inflection point, and at this inflection point, the surface speed of photoreceptor 173 coincides with the surface speed of transfer body 175.

Note that inflection point detection section 1013 may obtain differential values of the torque characteristics curve (FIG. 4*c*) and detect the inflection point from the peak of the differential value. Further, the inflection point may be detected from the point where second order differential value of the torque characteristics curve becomes zero.

Also, for accuracy enhancement, it is preferable to obtain an eventual inflection point from the average value of the inflection point during acceleration, which is obtained while the driving speed of photoreceptor 173 shifts from a low speed to a high speed, and the inflection point during deceleration, which is obtained while the driving speed of photoreceptor 173 shifts from a high speed side to a low speed.

Figure 4C:
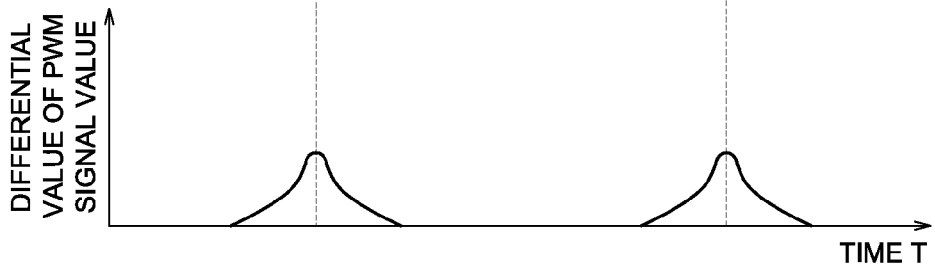
Figure 5:
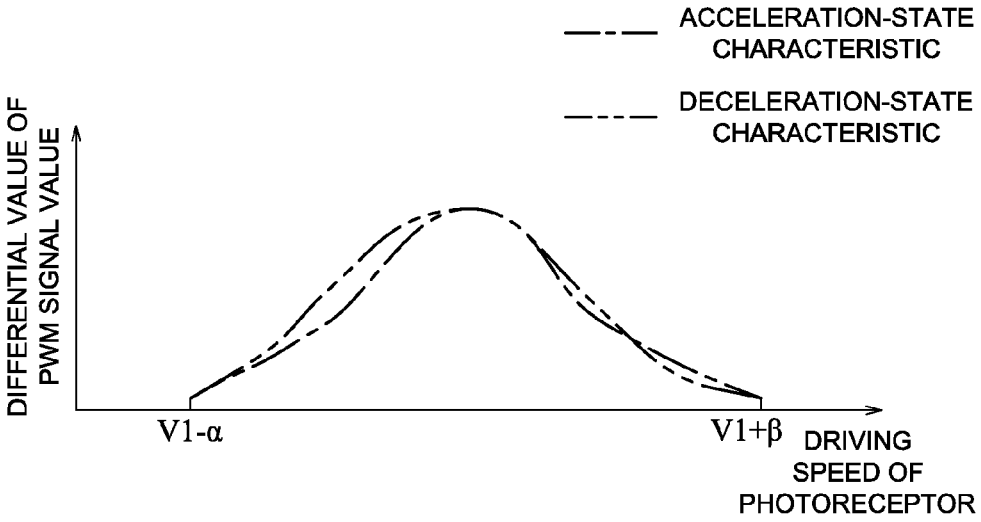
FIG. 5 is another characteristics diagram showing an operation of a preferred embodiment of the present invention.

In cases in which there exists bias toward left or right in the characteristics of differential value of torque characteristics curve as shown in FIG. 5 which is an enlarged view of FIG. 4*c*, it is preferable to consider the median point of the differentiated waveform, not the peak of differential values, to obtain the inflection point.

Further, instead of obtaining differential values of a torque characteristics curve, in cases in which the torque characteristics curve includes 100 or 200 sample values in the direction of the horizontal axis of FIGS. 4 (*a*), (*b*), and (*c*), by obtaining difference values between the PWM signal values at discrete positions of approximately 10 samples, the inflection point can be obtained from the peak of the difference values. Because the scope of torque characteristics curve becomes larger near the inflection point and the scope becomes smaller with increased distance from the inflection point, the inflection point can be obtained by this method using difference values at discrete positions.

Then, photoreceptor speed determination section 1014, in control section 101, obtains the driving speed of photoreceptor 173 which corresponds to the above-mentioned inflection point. In other words, photoreceptor speed determination section 1014 obtains the driving speed, from torque characteristics, at the state in which the actual surface speed of transfer body 175 coincides with the actual surface speed of photoreceptor 173, and determines the driving speed as the instruction speed for photoreceptor 173 (step S109 in FIG. 3). Namely, photoreceptor speed determination section 1014 determines from torque characteristics that both the surface speeds coincide, and obtains the driving speed of photoreceptor 173 at this time.

As described above, the surface speed matching control for photoreceptor 173 and transfer body 175 is complete. Note that, in cases of a color image forming apparatus, by obtaining the inflection point from the torque characteristics curve of each color as mentioned above, the instruction speeds for photoreceptors 173Y-173K are eventually determined by obtaining the average of the inflection point of each color, or the average of the inflection point of each color adjusted by median point.

As described above, by determining the instruction speed for photoreceptor 173 based on the inflection point of a torque characteristics curve, it is possible to drive photoreceptor 173 and transfer body 175 at the same surface speed without detecting the actual surface speeds of photoreceptor 173 and transfer body 175, and without being affected by errors in the diameter of photoreceptor, the diameter of the transfer body driving rollers, and the like. Thus, it is possible to prevent image drift, color drift, or driving errors from occurring.

Note that, when the change of driving speed of photoreceptor 173 and the extraction of torque characteristics are carried out (steps S103 to S107 in FIG. 3) as previously mentioned, it is preferable that control section 101 set the transfer voltage or transfer current at primary transfer section 176 lower than that in the case of normal image formation. By setting the transfer voltage or transfer current lower as mentioned above, the absorption force between photoreceptor 173 and transfer body 175 becomes weaker, and therefore, the above operations can be smoothly carried out.

Also, some image forming apparatuses are provided with a pressing mechanism, at primary transfer section 176, having functions to press transfer body 175 into contacted with photoreceptor 173 from inside of transfer body 175 when primary transfer is carried out, and to release the pressure when not necessary, or to variably adjust the pressure state. In those cases, when the change of driving speed of photoreceptor 173 and the extraction of torque characteristics are carried out (steps S103 to S107 in FIG. 3), as previously mentioned, it is preferred that control section 101 set the pressure at primary transfer section 176, under pressure-contact state, lower than that in the case of normal image formation. By setting the pressure strength at primary transfer section 176 lower, as mentioned above, the pressure to press photoreceptor 173 into contact with transfer body 175 becomes less, and therefore, the above operations can be smoothly carried out. Note that, in this case, it is preferable to maintain a certain level of the contact state between photoreceptor 173 and transfer body 175 because it becomes difficult to obtain the above mentioned inflection point of torque characteristics if transfer body 175 is separated from photoreceptor 173 completely.

Further, when the change of driving speed of photoreceptor 173 and the extraction of torque characteristics are carried out (steps S103 to S107 in FIG. 3) as previously mentioned, it is preferred that control section 101 control to form an arbitrary image on photoreceptor 173 so that a certain amount of toner exists on photoreceptor 173. With the existence of a certain amount of toner on photoreceptor 173, the friction coefficient between photoreceptor 173 and transfer body 175 becomes less, and therefore, the above operations can be smoothly carried out.

Further, it is preferred that control section 101 carry out the previously mentioned surface speed matching control for photoreceptor 173 and transfer body 175 in cases when: a) power is on, b) after continuous image formation for a certain period has been carried out, c) at magnification correction which accompanies the change of driving speed of transfer section 176, and d) at replacement of parts of photoreceptor 173, transfer section 176, or the like. In the case when power is on, it is preferred that control section 101 carry out a color registration adjustment, or the like, as appropriate, after carrying out the above mentioned surface speed matching control.

Although the preferred embodiment of the present invention have been fully described by way of examples with reference to the accompanying drawings, it is to be noted that various changes and modifications will be apparent to those skilled in the art. Therefore, unless such changes and modifications depart from the scope of the present invention, they are to be construed as being included therein.

What is claimed is:

1. An image forming apparatus comprising:

a photoreceptor for bearing a toner image;

a transfer body onto which the toner image borne by said photoreceptor is transferred;

a drive section for driving said photoreceptor and said transfer body, respectively; and a control section for controlling said drive section so as to drive said photoreceptor and said transfer body at a predetermined driving speed, wherein said control section is configured, under a state in which said control section controls to drive said transfer body at said predetermined driving speed, to control to: a) drive said photoreceptor while changing the driving speed of said photoreceptor within a range of driving speeds between a low speed and a high speed, including said predetermined driving speed, b) extract torque characteristics of said photoreceptor under the control which includes the change of driving speed of said photoreceptor, and c) determine the driving speed of said photoreceptor based on the extracted torque characteristics, wherein said control section is configured to obtain an inflection point of the extracted torque characteristics, and determines a driving speed which corresponds to the inflection point as the driving speed of said photoreceptor.

2. The image forming apparatus of claim 1, wherein said control section is configured to: a) obtain an inflection point during acceleration, which is obtained while the driving speed of said photoreceptor shifts from a low speed to a high speed, b) obtain an inflection point during deceleration, which is obtained while the driving speed of said photoreceptor shifts from a high speed to a low speed, and c) determines a driving speed, which corresponds to an average of said inflection point during acceleration and said inflection point during deceleration, as the driving speed of said photoreceptor.

3. The image forming apparatus of claim 1, further comprising a transfer section for transferring the toner image borne on a surface of said photoreceptor onto said transfer body, wherein said control section is configured, upon changing the driving speed of said photoreceptor, to set a transfer voltage or a transfer current at said transfer section to be lower than that in a case of forming an image.

4. The image forming apparatus of claim 1, further comprising a pressing section for applying a pressure to said photoreceptor and said transfer body, wherein said control section is configured, upon changing the driving speed of said photoreceptor; to set said pressure in pressing state to be lower than that in a case of forming an image.

5. The image forming apparatus of claim 1, further comprising an exposure section for forming an electrostatic latent image on the surface of said photoreceptor, and a developing section for developing said electrostatic latent image to form a toner image, wherein said control section is configured, upon changing the driving speed of said photoreceptor, to control said exposure section and said developing section so that a certain amount of toner exists on the surface of said photoreceptor.

6. The image forming apparatus of claim 1, wherein said control section is configured to obtain the inflection point of the extracted torque characteristics from a peak of differential values of a torque characteristics curve, based on the extracted torque characteristics, and determines a driving speed which corresponds to the inflection point as the driving speed of said photoreceptor.

7. The image forming apparatus of claim 1, wherein said control section is configured to obtain the inflection point of the extracted torque characteristics from a point where second order differential value of a torque characteristics curve, based on the extracted torque characteristics, becomes zero, and determines the driving speed which corresponds to the inflection point as a driving speed of said photoreceptor.

8. The image forming apparatus of claim 1, wherein said control section is configured to obtain the inflection point of the extracted torque characteristics from a median point of a differentiated waveform of a torque characteristics curve, based on the extracted torque characteristics, and determines a driving speed which corresponds to the inflection point as the driving speed of said photoreceptor.

9. The image forming apparatus of claim 1, wherein said control section is configured to obtain the inflection point of the extracted torque characteristics, by obtaining a plurality of difference values between PWM signal values at discrete positions of a torque characteristics curve, based on the extracted torque characteristics, and then obtaining a peak in the difference values as the inflection point, and determines a driving speed which corresponds to the inflection point as the driving speed of said photoreceptor.

10. The image forming apparatus of claim 1, wherein the image forming apparatus includes a plurality of photoreceptors, and said control section is configured, under the state in which said control section controls to drive said transfer body at said predetermined driving speed, to control to: a) drive each of said photoreceptors while changing the driving the speed of each photoreceptor within the range of driving speeds between the low speed and the high speed, including said predetermined driving speed, b) extract torque characteristics of said each photoreceptor under the control which includes the change of driving speed of said each photoreceptor, and c) determine the driving speed of said each photoreceptor based on the extracted torque characteristics.

* * * * *